US005750297A

United States Patent [19]

Evenstad et al.

[11] Patent Number: 5,750,297

[45] Date of Patent: May 12, 1998

[54] COLOR LITHOGRAPHIC REPRODUCTION

[76] Inventors: Damon F. Evenstad, 617 Meadow Dr., Glenview, Ill. 60025; Steven C. Evenstad, 442 Green Bay Rd., Kenilworth, Ill. 60043

[21] Appl. No.: 567,302

[22] Filed: Dec. 5, 1995

[51] Int. Cl.[6] ..... G03G 13/26

[52] U.S. Cl. ..... 430/42; 430/49

[58] Field of Search ..... 430/42, 41, 143, 430/156, 166, 49; 101/211, 450.1

[56] References Cited

U.S. PATENT DOCUMENTS

| | | | |
|---|---|---|---|
| 3,634,087 | 1/1972 | Houle et al. | 430/42 |
| 5,110,156 | 5/1992 | Axelrod | 283/117 |

*Primary Examiner*—John Goodrow
*Attorney, Agent, or Firm*—Walter C. Ramm

[57] ABSTRACT

Products, methods and inventive uses for introducing from an in-color subject image with pictorial content (14) and to electrostatic printing plates (21, 23, 25 and 27), respective ones of offset transfer images for four color separations from the subject image (22C, 24M, 26Y and 28K) by means of copier apparatus with a color separations function (30); and, making objectively superior printed images by the plates with the introduced transfer images. The subject image is supplied to the platen (31) of the apparatus. The plates are presented to the apparatus at or by an access facility such as an external tray (34) or a casette (38) at an internal site (37). The apparatus is worked in the function with reference to supplied subject image and presented plates. The introductions occur as, in the course of the working, the plates operationally transit of the apparatus. Thereafter, each plate may be etched and then mounted on a press (40). Each transfer image is defined by toner on the emulsion layer of the plate on which it is carried, and has a distribution or pattern of dots that, for pictorial content of the separation and in printed matter made with the plate, is at least equivalent to 150 line screen.

8 Claims, 3 Drawing Sheets

COLOR LITHOGRAPHIC REPRODUCTION

BACKGROUND OF THE INVENTION

Our invention relates to color lithographic reproduction and, specifically, to offset production of polychrome printed images with pictorial content by means of electrostatic printing plates in a printing arts context and with reference to such polychrome printed images as reproduced in instant printing shops.

According to state of the art practices in instant printing shops, offset production of a polychrome printed image with pictorial content necessarily involves expensive, time-consuming preparations as well as costly space, labor and specialized equipment. First, screened color separations must be derived from an original image in order to make printing plates. These separations are commonly in the form of film negatives for each of colors cyan (a blue), magenta (a red), yellow, and black, and they are customarily abbreviated as "CMYK".

Then, the film negative of each color separation must be stripped into a stripping sheet with accompanying line copy, if any, likewise as a photographically-made, dark-room-developed film negative. Each stripping sheet is conventionally transferred to a metallic (typically, aluminum) plate. Finally, each plate, on a press and with ink of the color of its separation, contributes to the whole printed image.

For an order for in-color printed matter with pictorial content, an instant printing shop often obtains color separations from one outside supplier and then, with the separations, makes the printing plates in house or procures them from a second supplier. Otherwise, the shop might out-source the whole job or refer the customer to another shop.

Further, each such color separation has a pattern of small dots for its contribution to pictorial content. These patterns are typically specified by halftone or line screen (dots/linear inch) and dot size or tint (% of maximum area the screen allows for one dot), and serve to impart corresponding patterns to printing plates and, ultimately, to printed images made with the plates. The patterns of dots for each of the CMYK separations, as combining in a printed image, allow a viewer of the image visually to average very large numbers of dots into areas of perceived tint or tone as well as of color.

A 120-line screen may well provide reasonably smooth tones and represent, in terms of quality and appearance of pictorial content in polychrome and monochrome printed matter, a sort of "good average" standard. Generally, larger numbers of dots—for example, by a 150-line screen—make for better pictorial content while fewer dots—for example, by an 85-line screen—result in a less attractive, inferior product.

SUMMARY OF THE INVENTION

This invention is based on our discovery that color copier apparatus may be used advantageously to impart transfer images for color separations to electrostatic printing plates and for superior quality in pictorial content of printed images made with the plates.

The Canon Laser Copier 700 product, supplied by Ambassador Office Products, Inc., 425 North Martingale, Schaumburg, Ill., is exemplary such color copier apparatus. This product has a function called "Offset Plate Original (Creating Color Separations of a Color Original)". The Advanced Operations Operator's Manual for the product, page 4–40, briefly notes this function, but neither the Manual nor other product literature call out any related operation or materials. This function implements capability to make CMYK separations as "four black copies" as originals from which screened film negatives may be made for transfer to metallic plates according to the described photographic and other prior art practices.

The Canon Laser Copier 700 product also has sites for copy-paper casettes. Such a site may be internal as in a drawer or behind a door. A casette at a site dispenses copy papers on which copies are made, and may be removed for re-filling and then replaced.

Printing plate products for this invention, as sheets and in rolls of various sizes, have long been and continue to be familiar as articles of commerce. Such products may be called "electrostatic masters" or, until press-ready, "printing plate precursors". The product supplied by AM International, Inc., 1800 West Central Road, Mount Prospect, Ill., and identified by reorder number 83-6-104976, is an exemplary such product in sheet form; each sheet is flexile, non-metallic and rectangular (with dimensions of 11×18.5 inches), and has one surface comprising a light-purple emulsion layer, and the other surface comprising substrate for the emulsion layer.

Electrostatic masters are also specified in terms of halftone or line screen; see page 1–3 of Offset Supplies Dealer Catalogue dated June 1995 of Graphic Technologies, Inc., of Wheeling, Illinois. Such a specification indicates the line screen that a particular master will accept on its emulsion layer and satisfactorily impart to a printed image; for example, the noted AM International product is for a 120-line screen. Line screens bespeak the state of the art, are indices of quality and appearance of pictorial content of printed images made with masters, and cover a range between 85-line and 120-line screens.

In this summary and elsewhere in this specification—

"plate" means a non-metallic electrostatic master such as the noted AM International product or an equivalent product, whether as a printing plate precursor, or comprising a transfer image, or fully prepared, mounted on a press and working.

"dot" means a small finite area of any shape or configuration.

"CLC700" means the Cannon Color Laser Copier 700 product.

"separations function" means the Offset Plate Original (Creating Color Separations of a Color Original) function of the CLC700, as noted, or an equivalent function.

"CLC apparatus" includes a CLC700 embodiment and equivalent apparatus with a separations function.

"subject image" means a polychrome presentation with pictorial content and available, as an original, for copying by photography, xerography or otherwise.

The general object of the invention is readily to provide for color lithographic reproductions of high quality. Within the general object, specific objects include improved plates for pictorial content of such reproductions, expanded availability of such reproductions, novel versions of plates for color printing, and less costly preparation of plates for and more reliable production of polychrome printed matter.

In summary, to accomplish these objects, this invention provides direct introduction of transfer images for color separations to plates by use of CLG apparatus, and for pictorial content of superior appearance and quality in printed images produced by the plates. The invention obviates costly, time-intensive practices and expensive equipment of the prior art, including screens, screened images and the space for and work of process photography and photo-development. Indeed, it has enabled us effectively to decommission the dark-room and plate-making and process cameras of our instant printing shop.

According to the invention, C, M, Y and K transfer images are introduced to plates by working CLC apparatus in separations function with reference to to a subject image and four plates. Each plate is presented to the apparatus for transit of the copy path. Color management features of the apparatus may be utilized for a presented separation. The apparatus may be operated as if the plates are heavy card stock of unusually large size.

The invention has product and method aspects pertaining to CLC apparatus, plates, and transfer images for color separations on and printed images made with plates. Despite wide distribution, popularity and usage of such apparatus and electrostatic masters, such products and methods appear neither known, available, nor in public use.

REFERENCE NUMERALS AND CHARACTERS

Figure 1:
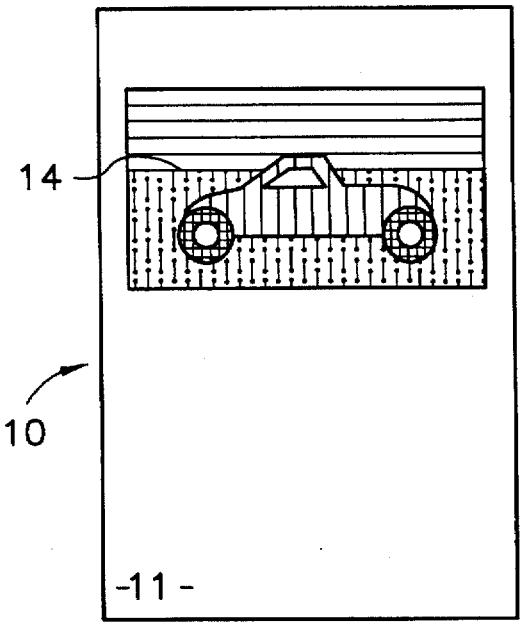
FIG. 1 is a sketch of an article including an exemplary subject image with in-color pictorial content. The pictorial content is a red auto with black tires on a yellow road and beneath a blue sky, and is lined to indicate those colors.

In the drawings and this specification, reference numerals characters identify structures, parts, elements, features, and aspects of and other matters relating to this invention. Thus—

Numeral 10 is a subject-image article.

In and of article 10—

11 is the face or obverse side.

12 is the back or reverse side.

14 indicates a subject image on face 11.

Numeral 20 is a set or plurality of plates.

In, of or with reference to the plates of set 20—

21 is a first plate.

22 is the emulsion-layer side of plate 21.

22C is a transfer image for a cyan separation on side 22.

23 is a second plate.

24 is the emulsion-layer side of plate 23.

24M is a transfer image for a magenta separation on side 24.

25 is a third plate.

26 is the emulsion-layer side of plate 25.

26Y is a transfer image for a yellow separation on side 26.

27 is a fourth plate.

28 is the emulsion-layer side of plate 27.

28K is a transfer image for a black separation on side 28.

29 is the substrate side of plate 27.

Numeral 30 is CLC apparatus.

In, of or with reference to apparatus 30—

31 is the platen or copy board.

32 is the "operate" button.

33 is the cover

34 is the exterior by-pass tray.

35 is the finished copy tray.

36 is the control panel

37 is a casette site.

38 is a casette or plate-housing structure.

39 is an assemblage comprising set 20 and casette 38.

D1 is the photo-sensitive drum.

D2 is the transfer drum.

P1 indicates a first copy path.

P2 indicates a second path path.

Numeral 40 generally indicates an offset printing press.

In, of and with reference to press 40—

41 is the plate cylinder.

42 is the blanket cylinder.

43 is the ink rollers.

44 is a partial printed image in cyan on paper which corresponds to and is as printed from image 22C.

45 indicates other elements of press 40 including impression and sheet-transfer cylinders.

DESCRIPTION OF PREFERRED EMBODIMENTS AND BEST MODES

Products, methods and uses of this invention, in their several aspects, including structure and operability, and according to these descriptions, represent preferred embodiments and best modes of the invention. In some such aspects, an embodiment or method may represent an improvement of or with reference to color lithographic products and practices as otherwise known to the art.

Figure 2:
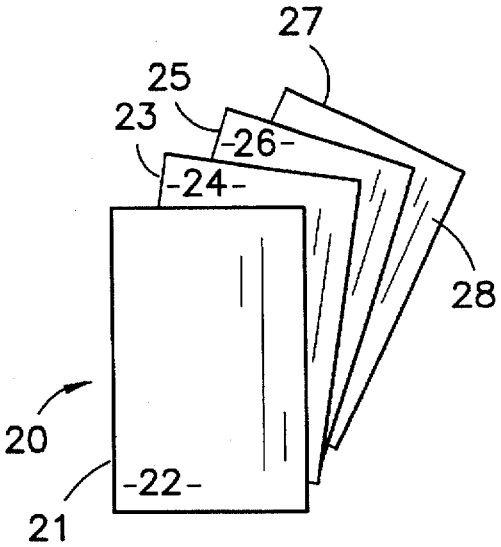
FIG. 2 is a perspective view of four plates.

FIGS. 1–7 illustrate articles and methods of, and apparatus with which to practice, this invention. FIG. 1 shows article 10 as planar and image 14 with in-color pictorial content on side 11. FIG. 2 shows plates 21, 23, 25 and 27 of set 20. The plates are identical, image-less, and in sheet form and new condition. Sides 22, 24, 26 and 28 have a forward orientation.

We believe these circumstances are noteworthy as to the plates of set 20. Papers and board stock for copiers, including CLC apparatus, are invariably specified by weight ("pounds") but plates are not. A 11×18 inch plate exceeds the size that, according to product literature, tray 34 of the CLC700 product is indicated to accept.

Figure 3:
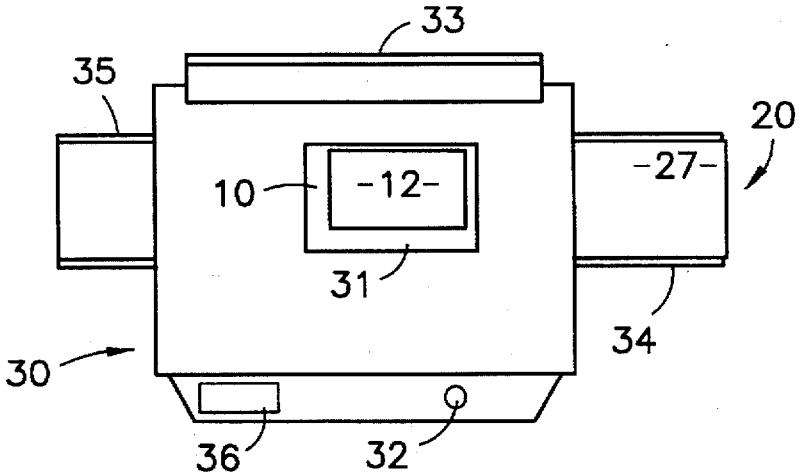
FIG. 3 is a plan view of CLC apparatus with a platen and by-pass tray. The article of FIG. 1 is on the platen. The plates of FIG. 2 are in a stack in the by-pass tray.

FIG. 3 shows article 10 as supplied to and set 20 as presented, in a first manner of presentation, to apparatus 30. Image 14 is toward platen 31 as for making a copy of the image. The plates, in the same condition as in FIG. 2, are disposed in and as a stack in tray 34. Plate 27 happens to be atop the stack, and each plate above has registered or covering relationship as to the plate below. Sides 22, 24, 28 and 28 are upward as for receiving a copy. Panel 36 and button 32 are accessible. The apparatus and plates are ready for an operator to select the separations function from the panel and for operation of the apparatus when the operator presses button 32. With specific reference to CLC700, the selection is made by touching the Composition key and the OFFSET PLATE ORIGINAL key as those keys present on the panel.

Figure 4:
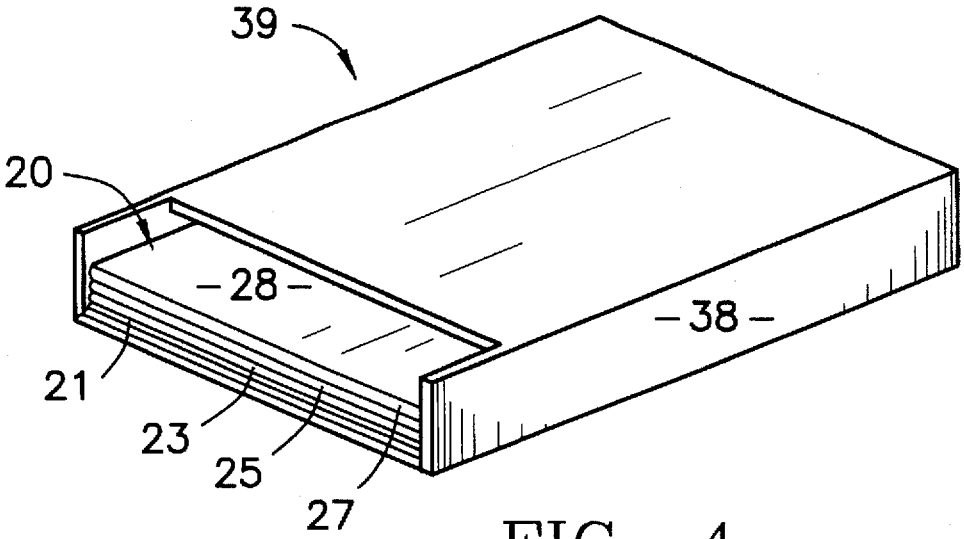
FIG. 4 is a perspective view of an assemblage comprising a casette and the plates of FIG. 2. Part of the casette is removed in order to show disposition of the plates.
Figure 5:
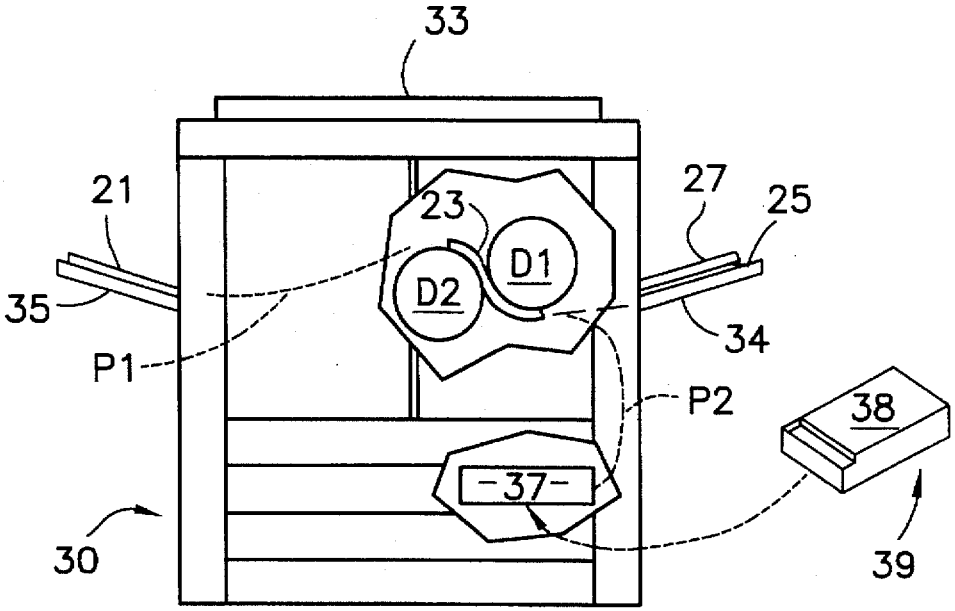
FIG. 5 is a front elevation sketch including the apparatus of FIG. 3 and the assemblage of FIG. 4. Portions of the apparatus are removed in order to disclose, interiorally of the apparatus, the drums, a casette site and a plate in transit of a copy path of the apparatus.

FIG. 4 shows assemblage 39 for presenting set 20 to apparatus 30 in a second manner of presentation, that is, from casette 38. The assemblage is for location or placement, like a copy-paper casette, at site 37 (FIG. 5). Plates 21, 23, 25 and 27 are in the same condition as in FIG. 2 and of suitable size for transit of the apparatus from the casette. The casette has a planar bottom and may be for sheets of, say, 11×17 inch size. The plates may be as cut down from a larger size. Or the assemblage may be made in one or several of sizes of casette so that, for each such size, a number of dimensionally matching plates is in the casette and the casette is configured and otherwise adapted for location or placement at site 37. The number of plates, N, may equal the multiplication product of 4 and an integer.

In any case, the plates of set 20 are loaded in casette 38 as an uncramped, well contained stack or nestage. The plates are generally parallel to the bottom of the casette, and emulsion-layer sides are disposed as to receive a copy in the course of transit. With specific reference to CLC700, emulsion-layer sides are downward, as in FIG. 4, and the plates need not be processed as heavy card stock.

FIG. 5 includes apparatus 30, with site 37, path P1 and path P2, and assemblage 39 ready to be placed in the site. The paths are for and accommodate trans-apparatus operational transit by the plates of set 20. Path P1 runs from tray 34 and interiorally of the apparatus, with no-air gap passage between drums D1/D2, to tray 35. When the apparatus is operated as to a stack of plates in tray 34, as FIG. 3, the plates serially feed from the bottom of the stack and are transported across path P1 to tray 35. For safety considerations, passage of a plate between the drums should not be directly observed. In FIG. 5, plate 21 has completed transit of, plate 23 is on, and plates 25 and 27 await transit of path P1.

Path P2 runs from site 37 within apparatus 30 to join path P1 up-path of drums D1 and D2. When assemblage 39 is placed at the site, the apparatus is ready to be operated and serially to transport the plates of set 20 via path P2 and part of path P1 to tray 35.

Figure 6:
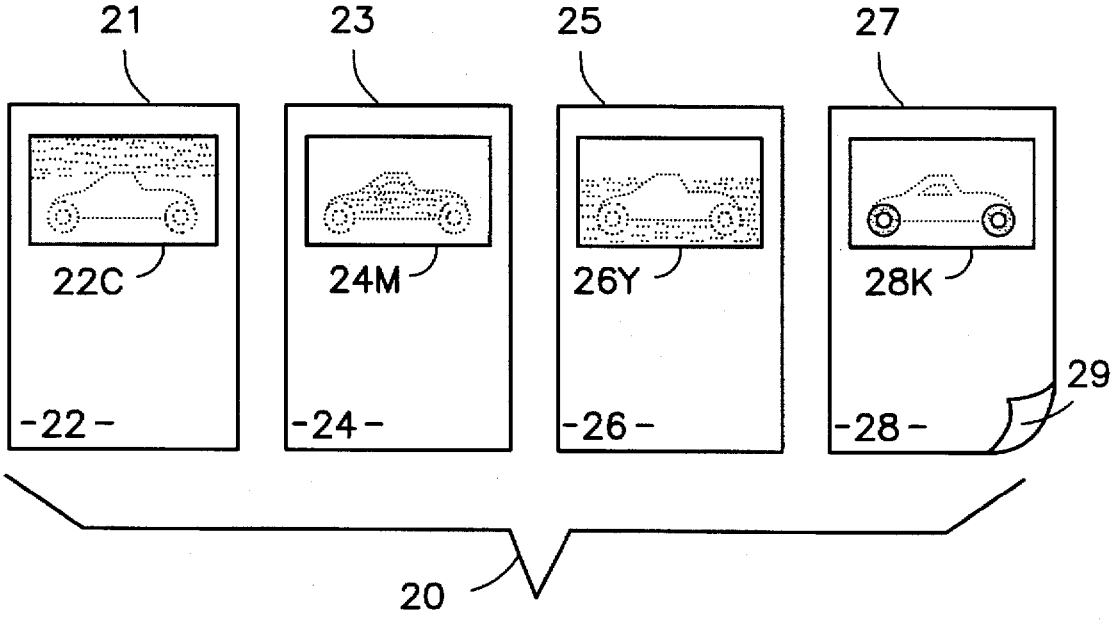
FIG. 6 is a plan view of the plates of FIG. 2. Each plate now has a transfer image for one color separation from the subject image of FIG. 1.

FIG. 6 shows set 20 after plates 21, 23, 15 and 27 have made operational transit of apparatus 30. Each plate carries a transfer image for one color separation from subject image 14 on its emulsion-layer side and with a pictorial component represetative of and corresponding to a least some of the subject image's pictorial content, including gray scales of the separation. A corner of plate 27 is bent to disclose side 29 and illustrate the flexile character of each plate.

In particular, side 22 of plate 21 exhibits image 22C for the cyan separation (blue sky). Similarly, images 24M, 26Y and 28K are for the other three separations. Each transfer image is visible, available for inspection, "positive" to the subject image, and defined by toner from apparatus 30 as deposited and fixed on the plates. The transfer images are in black but could, as well, be of another suitable monochrome toner. Sides 22, 24, 26 and 28 are ready to be etched in a manner and with materials conventional for electrostatic masters to render non-transfer image areas hydrophilic. As etched, these sides fit their plates for useful and substantial run length.

Still referring to FIG. 6, each of images 22C, 24M, 26Y and 28K features, comprises and is characterized by a distribution of toner-defined small dots. These distributions of dots may be stochastic. In any case, these distributions impart to their respective plates, with reference to subject image 14 and for the pictorial components of the transfer images, lithographic reproduction capability at least equivalent to and, typically, notably superior to capability as would be imparted by 150-line screen. Thus, our invention confers on and in respect of articles in the electrostatic masters class capability to accept transfer images and to make a printed images that objectively and substantially exceed well-known, state-of-the-art line screen specifications for those articles.

Figure 7:
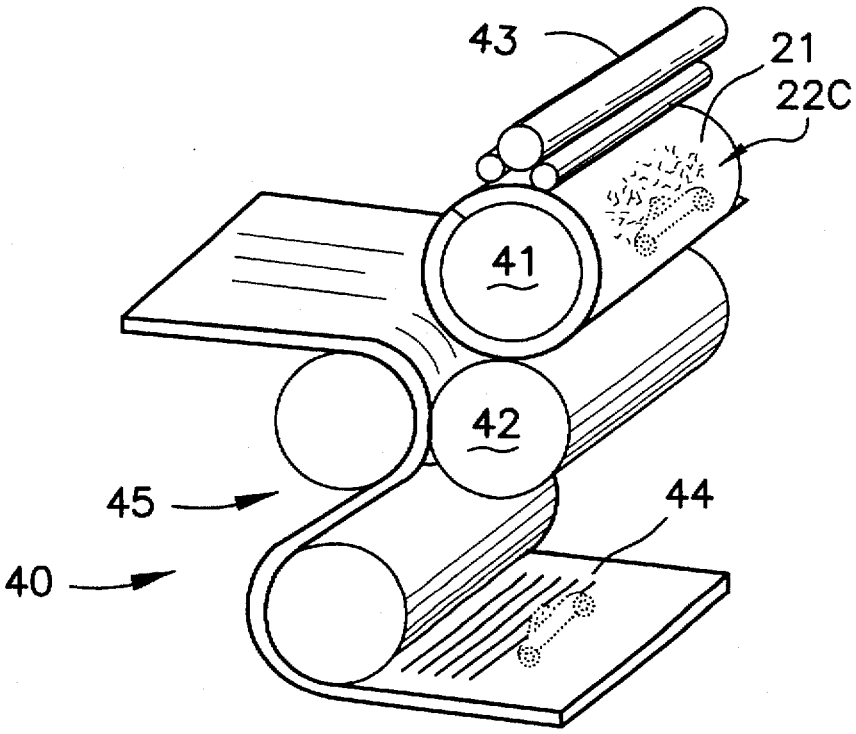
FIG. 7 is a sketch of elements of a conventional offset printing press with one plate of the set of FIG. 6 on the plate cylinder.

Referring to FIG. 7, plate 21 is on cylinder 41 of press 40. Cylinder 41 turns clockwise, and cylinder 42 turns counter-clockwise. Side 22 outwardly presents image 22C; its non-tranfer image areas are hydrophilic. The press is producing image 44 which has a pictorial component corresponding to image 22C and is yet partial as to image 14. Again, the pictorial component of image 44 represents in terms of its contribution to a whole printed image corresponding to image 14 at least equivalent to 150-line screen. Rollers 43 supply cyan ink.

A first method of our invention provides at least one plate with a transfer image to contribute to color lithogrphic reproduction and for a one of the CMYK group of color separations, and includes these steps:

(a) presenting the plate, such as plate 23, to a color copier, such as apparatus 30, at or by way of a suitable entry facility of the apparatus, and as for making a copy on the emulsion-layer side of the plate, such as side 24;

(b) supplying a subject image, such as image 14, to the color copier as for copying the image, such as at platen 31; and, (c) introducing a transfer image for one color separation to the plate by operating the copier in the separations function, such as by keys on panel 38 and button 32.

This first method may be described as initial preparation and is, of course, typically practised as to a plurality of plates, such as set 20. and serves to create a transfer image for one color separation on the emulsion-layer side of each plate. As noted, for purposes of step (a), plates may be presented from a generally vertical stack at or in a facility such as tray 34 (FIGS. 3 and 5), in which case the emulsion-layer sides are upward, or casette 38 (FIGS. 4–5) wherein those sides are in downward disposition; and, in step (b) image 14 is toward the platen (FIG. 3). Steps (a) and (b) are sequentially interchangeable and performed during one time period, and step (c) is performed later or after the time period.

This first method may well be practiced at a first location, such as a service bureau or copy shop, with apparatus, such as apparatus 30, and a supply of plate articles, and for making plate for one or more of CMYK separations as articles of commerce which are then to be transported to and utilized at a second location.

Other methods of our invention, for further preparation of plates with and for cooperative utilization of introduced transfer images, extend the first method toward and to actual color lithographic reproduction. Thus, subsequent to steps (a), (b) and (c), additional steps may include:

(d) conventional rendering non-transfer image areas on the emulsion-layer sides hydrophylic, as on sides 22, 24, 26 and 28; and, (e) mounting the plates whereof the non-transfer images areas are hydrolphilic on one or several presses, such as press 40, and operating it/them for a press run for each of the separations.

Step (d) may involve application of a wetting liquid and serve to complete preparation of the plates at a said first location and before they are utilized at a said second location.

According to a method comprising steps (a) through (e), each fully-prepared plate of set 20 contributes to and cooperates with the other three plates in producing a polychrome printed image.

Inventive uses of our invention, as novel and unexpected in terms of the commercial history of electrostatic masters and the wide availability and use of color copiers establishes a special use and operation of the copiers. This inventive use serves directly and immediately to introduce offset transfer images, each for a particular color separation.

Apart from the several product, method and use aspects of our invention as described in this specification, other embodiments and methods for transfer image creation for color lithographic reproductions and of utilization of such transfer images are within the spirit and scope of the invention.

What is claimed is:

1. The method of initial preparation of an electrostatic master with a first side, for contribution to color lithographic reproduction of a subject image with polychrome pictorial content, comprising during one time period steps of supplying the subject image to a color copier with a color separations function and as for copying the subject image, and presenting the master to the copier as for making a copy of the subject image on the first side; and after the time period, the step of operating the copier in the separations function with reference to the subject image and the master.

2. The method of claim 1 where step of operating the copier in the separations function introduces a toner-defined transfer image for one color separation to the first side of the electrostatic master.

3. The method of introducing transfer images to N electrostatic masters, each with an emulsion layer and having the same specified halftone screen, for color reproduction of a polychrome subject image, comprising during one period of time, steps of (a) supplying the subject image to color copier apparatus with a color separations function and as for copying the subject image, and (b) presenting the electrostatic masters to the apparatus as for making a copy of the subject image on the emulsion layer of each master; and, after the period of time, (c) operating the apparatus in the color separations function with reference to the subject image and the electrostatic masters to introduce a transfer image for one separation of the color separations to the emulsion layer of respective ones of the masters.

4. The method of claim 3 where the subject image comprises pictorial content, the electrostatic masters have specified halftone screen of not more than 120 line, step (b) includes disposing the electrostatic masters in a stack in an access facility of the color copier apparatus for serial transit of the apparatus, and step (c) introduces a toner-defined transfer image for one separation of CMYK color separations to the emulsion layer of respective ones of the electrostatic masters, and confers lithographic reproduction capability, with regard to the pictorial content, superior to a halftone screen of 150 line.

5. The method of claim 4 where N is the multiplication product of 4 and an integer, and step (b) includes disposing the masters in the stack with the emulsion layers upward.

6. The method of claim 4 where N is the multiplication product of 4 and an integer, and step (b) includes loading the masters in a casette having a bottom with the emulsion layers toward the bottom of the casette and placing the casette in the apparatus.

7. The method of preparing masters for color lithographic reproduction according to the method of claim 4 and including, as additional step (d), rendering non-transfer image areas of the emulsion layers hydrophylic.

8. The method of color lithographic reproduction which comprises the method of claim 7 and includes, subsequent to step (d) and as additional step (e), mounting the prepared masters on one or several presses and operating the press or presses for a press run for each color separation.

* * * * *